US008272729B2

(12) United States Patent
Caiger et al.

(10) Patent No.: US 8,272,729 B2
(45) Date of Patent: Sep. 25, 2012

(54) INK JET PRINTER AND A PROCESS OF INK JET PRINTING

(75) Inventors: Nigel Anthony Caiger, Wookey Hole (GB); Hartley David Selman, Bristol (GB); Shaun Lawrence Herlihy, Chatham (GB)

(73) Assignee: Sun Chemical Corporation, Parsippany, NJ (US)

( * ) Notice: Subject to any disclaimer, the term of this patent is extended or adjusted under 35 U.S.C. 154(b) by 152 days.

(21) Appl. No.: 12/517,627

(22) PCT Filed: Nov. 30, 2007

(86) PCT No.: PCT/US2007/086113

§ 371 (c)(1),
(2), (4) Date: Jun. 4, 2009

(87) PCT Pub. No.: WO2008/070563

PCT Pub. Date: Jun. 12, 2008

(65) Prior Publication Data

US 2010/0033545 A1 Feb. 11, 2010

(30) Foreign Application Priority Data

Dec. 6, 2006 (GB) ..... 0624451.1

(51) Int. Cl.
*B41J 2/01* (2006.01)

(52) U.S. Cl. ..... 347/102; 347/101

(58) Field of Classification Search ..... 347/102, 347/101

See application file for complete search history.

(56) References Cited

U.S. PATENT DOCUMENTS

| | | | | |
|---|---|---|---|---|
| 4,340,893 | A * | 7/1982 | Ort | 347/102 |
| 5,275,646 | A | 1/1994 | Marshall et al. | |
| 5,757,407 | A * | 5/1998 | Rezanka | 347/102 |
| 6,092,891 | A * | 7/2000 | Okubo et al. | 347/104 |
| 6,247,808 | B1 * | 6/2001 | Ma et al. | 347/100 |
| 6,719,420 | B2 * | 4/2004 | Tomioka et al. | 347/100 |
| 6,746,114 | B2 * | 6/2004 | Takahashi et al. | 347/100 |
| 2002/0062762 | A1 * | 5/2002 | Tomioka et al. | 106/31.33 |
| 2002/0149660 | A1 * | 10/2002 | Cleary et al. | 347/102 |
| 2004/0041893 | A1 | 3/2004 | Hoshino | |
| 2004/0075726 | A1 | 4/2004 | Hirai | |
| 2006/0023058 | A1 | 2/2006 | Tanaka | |

(Continued)

FOREIGN PATENT DOCUMENTS

CN 1531484 A 9/2004

(Continued)

OTHER PUBLICATIONS

International Search Report and Written Opinion issued for International Application No. PCT/US2007/086113, dated Apr. 21, 2008.

*Primary Examiner* — Stephen Meier
*Assistant Examiner* — Leonard S Liang
(74) *Attorney, Agent, or Firm* — McKenna, Long and Aldridge, LLP.

(57) ABSTRACT

An ink jet printer for printing a cationic ink jet ink is provided. The printer comprises a print head for printing the ink onto a substrate, a heating means for heating the ink on the substrate, and a source of radiation for curing the heated ink.

18 Claims, 6 Drawing Sheets

U.S. PATENT DOCUMENTS

2007/0109382 A1* 5/2007 Lafleche et al. ..... 347/102

FOREIGN PATENT DOCUMENTS

| | | |
|---|---|---|
| JP | 2002-137375 | 5/2002 |
| JP | 2004-136579 | 5/2004 |
| JP | 2005-125513 | 5/2005 |
| JP | 2006-142612 | 6/2006 |
| JP | 2006-142613 | 6/2006 |
| JP | 2006-231795 | 9/2006 |
| WO | WO02053384 | 7/2002 |

* cited by examiner

Dose (mJ/cm$^2$ – IL390B)

Dose (mJ/cm$^2$ – IL390B)

INK JET PRINTER AND A PROCESS OF INK JET PRINTING

CROSS REFERENCE TO RELATED APPLICATIONS

This application is the United States national phase filing of the corresponding international application number PCT/US2007/086113, filed on Nov. 30, 2007, which claims priority to and benefit of GB Application No. 0624451.1, filed Dec. 6, 2006, which applications are hereby incorporated by reference in their entirety.

The invention relates to an ink jet printer for printing UV curable inks and to a process of ink jet printing.

Ink jet printing has become widely established as a method for printing graphic display and other products on rigid and flexible substrates. Small desk top ink jet printers for office or home use typically print with water-based inks. Such inks are relatively inexpensive and are reasonably environmentally acceptable but suffer from a number of disadvantages including the length of time taken for the ink to dry and poor print quality on non-water absorbing substrates such as plastic films. Ink jet printers for small scale commercial use such as the wide format printers found in high street print and copying shops may use solvent-based inks which dry more rapidly than water-based inks and are more compatible with hydrophobic substrates but which are less environmentally acceptable and generate undesirable odour during the printing process. At the upper end of the scale, large commercial ink jet printers for wide format printing of large graphic display products and industrial decoration equipment such as CD printers typically use radiation curable inks, particularly ultraviolet (UV) curable inks.

UV curable inks can be cured rapidly by using high doses of UV radiation to give durable images of high print quality on a wide variety of substrates. Moreover, UV curable inks are in general free of volatile organic components and are therefore more environmentally acceptable than solvent-based inks. Almost without exception, UV curable ink jet inks in commercial use are based on components which cure by a free radical mechanism. A wide range of such components is available thereby providing for flexibility to tailor the ink to the particular requirements of the printer.

Despite its many advantages, UV curing ink jet has failed to become established widely other than for large scale printing operations. One possible reason is that the mercury lamps typically used to generate UV radiation for curing the ink are inconvenient to use because they take time to heat up and cool down and if broken can release mercury which is highly toxic. Moreover, existing UV curing printers have to date tended to be too large and complex for the home or high street printer market.

There therefore remains a need for a improved UV curing ink jet printer.

The invention provides an ink jet printer for printing a cationic ink jet ink comprising a print head for printing the ink onto a substrate, a heating means for heating the ink on the substrate and a source of radiation for curing the heated ink.

The invention also comprises a process of ink jet printing using the steps of:

i) ink jet printing a cationic ink jet ink onto a substrate;

ii) heating the ink on the substrate; and iii) using UV radiation to cure the ink.

Cationic ink jet inks have to date not found wide commercial acceptance partly because cationic ink jet inks have tended to be slower to cure than free radical ink jet inks so that the printed articles must be handled carefully for some time after printing in order not to damage the partially-cured image. Attempts to improve the cure speed of cationic inks by including higher levels of reactive monomers such as dioxetane have not succeeded commercially because the resulting films of cured ink tend to be brittle and therefore lack durability. Further attempts using high photoinitiator levels have also failed to significantly increase cure speed.

The curing of free radical ink jet inks is inhibited by the presence of atmospheric oxygen and known UV ink jet printing apparatus must therefore give a high dose of UV radiation and/or include means for excluding atmospheric oxygen from the printed substrate prior to and during the curing step. Furthermore, the curing of free radical inks has been found not to increase or to increase only to a very small extent at elevated temperatures. The present inventors have found that a printer which utilises cationic UV curing ink (which does not suffer from oxygen inhibition) in combination with a means for heating the ink prior to curing so that it is cured at an elevated temperature makes possible an increase in the cure speed of the ink such that the printed product can be handled and stacked directly following printing. Moreover, the use of cationic inks is associated with other benefits as compared to free radical inks, including lower odour and lower skin irritancy, and improved adhesion to the substrate due to a decreased level of shrinkage on curing.

The terms "cationic ink" and "cationic ink jet ink" as used herein refers to inks which in use cure by a cationic mechanism. Those inks include inks commonly known as hybrid inks which contain both catioinically curable and free radical curable compounds and which cure by a combination of both mechanisms. Advantageously, however, the ink cures solely by a cationic mechanism.

The terms "free radical ink" and "free radical ink jet ink" as used herein refer to inks which cure by a free radical mechanism and have no cationic curing component.

In the process of the invention, the ink is heated before and/or while it is cured, that is, while it is wet and the ink is cured at an elevated temperature so that the initial burst of curing activity which occurs on exposure to the UV radiation benefits from the rate enhancement resulting from the elevated temperature of the ink. The printer and printing process of the invention are therefore distinguished from attempts which have been made in the past to improve the curing of cationic ink jet inks by heating them after their exposure to the UV radiation (i.e. post curing).

The heating means may be any suitable device for heating the ink on the substrate. The heating means is arranged to heat the ink on the substrate before and/or during the exposure of the ink to the curing UV radiation. The heating means may, for example, be a source of infrared (IR) radiation such as an IR lamp which is arranged to shine IR radiation onto the wet ink. Optionally, the heating means is an IR LED or an IR LED array. In one embodiment, the heating means is a source of near infrared (NIR) or radio frequency (RF) radiation. The source of near infrared (NIR) radiation may be a NIR lamp or LED array. Preferably, the source of NIR has a peak emission wavelength in the range of from 750 μm to 1400 μm. The source of RF radiation may be an RF dielectric heater of the type used for drying water based coatings, adhesives and emulsions. NIR and RF heating are especially suitable for use in the present invention because they are absorbed well by the ink but may only be poorly absorbed by the substrate where the substrate has a few dipoles present, e.g., polyethylene and polypropylene. Accordingly, the ink is preferentially heated and the substrate experiences a lesser degree of heating. In that way, heat sensitive substrates such as thin gauge polymeric films can be printed whilst minimising the effects of the heat on the substrate. Accordingly, in one embodiment the substrate is a thin gauge (i.e. having a thickness of no more than 100 μm) polymeric film and the heating of the ink is by NIR radiation or by RF radiation, preferably NIR radiation The heating means may be a heated platen. The platen will typically be in contact with the underside of the substrate prior to and/or during the curing of the ink. Preferably, the heated platen is fixed below the print head and extends over the region between the print head and the curing means so that as the substrate passes over the platen it becomes warm, thereby heating up the ink which is carried on the substrate. The heated platen may be of the type used in conventional ink jet printers for solvent-based inks. In those printers the heated platen is used to promote drying of the ink. The heated platen typically includes an electric heating element. The heated platen is advantageously heated to a temperature in the range of from 30° C. to 100° C., or preferably in the range of from 30° C. to 50° C. The printer is preferably such that the heating means raises the temperature of the ink by at least 2° C., preferably at least 5° C.

The inventors have found that it is possible to achieve remarkable increases in the curing speed of cationic ink jets inks in the printer of the invention with only a relatively small increase in the temperature of the ink. In some cases an increase of only 5° C. has proved effective and has more than doubled the cure rate of the ink. Advantageously, the heating step is such that the ink reaches a temperature of at least 30° C., preferably at least 35° C. and more preferably at least 40° C. immediately prior to the curing of the ink. Heating the ink to a temperature which causes decomposition of either the ink or the substrate should be avoided. Advantageously, the ink is heated to a temperature not more than 100° C., preferably not more than 80° C., and optionally not more than 60° C. In a preferred embodiment, the ink is heated such that it is at a temperature in the range of from 30° C. to 50° C. immediately prior to the curing of the ink.

The curing means may be any radiation source that emits energy at a suitable wavelength to cure the inks. UV lamps that emit radiation at wavelengths between 200 μm and 450 μm are suitable for curing UV curable inks. Traditionally, the radiation source of choice for UV ink jet printing has been the mercury vapour lamp. However, there are a number of disadvantages with those mercury vapour lamps. They are often very inefficient with only a small proportion of the radiation being emitted at the desired wavelengths. Furthermore, traditional mercury lamps are also temperature sensitive, that is, they emit light at the required wavelength only when hot. Accordingly, the response time of the lamp is usually rather slow because they need to be warmed up prior to use or alternatively the lamp needs to be kept warm on a standby mode, which is wasteful of energy. The light intensity is often variable which leads to variations in the properties of the cured ink. Furthermore, and perhaps most importantly, traditional UV lamps are typically large and heavy so they are difficult to mount on ink jet printing heads, especially printing heads that are mounted on a moving carriage. Nonetheless, mercury vapour lamps may be used as the radiation source in the printer of the invention. (Mercury lamps do generate a significant amount of IR radiation and so have a heating effect of their own. However, for the purposes of the present application where a mercury lamp is present in the printer it is not to be regarded as a heating means and the printer will comprise a separate means for heating the ink on the substrate.) Preferably, however, the radiation source is a UV LED or an array of UV LEDS. UV LED light sources have rapid response times and therefore do not require preheating and are relatively compact and light as compared to the mercury lamps. They are therefore relatively easy to integrate onto a print headed mounted on a moving carriage.

A further advantage of UV LEDs is that they are digitally addressable and can therefore be fired individually when desired to cure selected areas of the substrate upon which ink has been printed and need not be fired to illuminate areas which are free of ink, thereby giving further energy savings. Such digital curing is described, for example, in US 2006/0119686.

The curing means may include an LED array having a mixture of UV LEDs having different UV peak emission wavelengths. Such mixed arrays are described, for example, in US 2006/0050122A, US 2006/0204670 and US 2004/016435. Such mixed arrays have found to give good curing of both thick and thin layers of ink and also mitigate the variation in the absorption of the UV light by the pigments in inks of different colours. US 2006/0204670A and US 2004/0164325A also disclose various means for excluding oxygen from the inks to reduce oxygen inhibition of curing, which is a problem with free radical inks, but not with cationic inks and the mixed UV arrays disclosed in those documents also help to mitigate the effects of oxygen inhibition by providing a UV radiation of short wavelength, which promotes the curing of the surface region of the ink, where oxygen inhibition is most significant. Of course, the cationic inks used in the printer and process of the present invention do not suffer from oxygen inhibition in the same way as free radical inks do and therefore it is not necessary to include a source of short wavelength UV for that reason, although the use of a mixed wavelength UV LED array is desirable for the other reasons mentioned above.

Both mercury lamps and UV LEDs suffer from the problem that they generate a lot of heat which can damage temperature sensitive substrates. Furthermore, light intensity generated by an LED typically falls as the temperature of the LED rises. For that reason, LED UV sources are typically provided with cooling means such as heat sinks and fans to maintain the LED at an acceptable temperature.

The printer may be a scanning printer. In scanning printers, the print head scans from side to side across the substrate as the substrate moves longitudinally beneath it and in that way the print head covers the full area of the substrate. In a preferred embodiment, the printer is a scanning printer which comprises one or more UV LED arrays arranged on either side of the print head. The LED arrays scan across the substrate with a print head and therefore desirably cover the full printing area of the substrate. In that embodiment, the print head may also carry one or more sources of IR radiation arranged either side of the print head to heat the ink. The invention is especially suitable for scanning printers because those printers tend to find application in market segments where the benefits of size reduction and cost provided by the invention are of particular value.

The invention is also applicable to other types of ink jet printer including single pass ink jet printers. In single pass ink jet printers the print head extends across the full width of the printing area and does not scan from side to side. In a single pass printer the UV light source is typically arranged just downstream of the print head. In one embodiment, the printer is a single pass ink jet printer having a source of UV radiation downstream of the printer and also including a heat source arranged between the print head and the UV source. The heat source in the single pass printer may be a heated platen but because the substrate will move through the printer relatively fast as compared to a scanning printer, radiation heat sources such as an IR or NIR lamp are preferred.

The invention also provides an ink jet printer comprising one or more reservoirs containing cationic ink jet ink, a print head for printing the cationic ink jet ink onto the substrate, and a heating means for heating the ink on the substrate.

The substrate which may be any suitable substrate including those typically used in ink jet printers such as paper, acrylic, vinyl and polyester sheets and flexible or rigid graphic display substrates such as polycarbonate, PET, glass, ceramic and metal.

In a preferred embodiment, the printer of the invention includes the print head, the means for heating the ink and the means for curing the ink within a single housing. Optionally, the printer is a printer for printing sheet or web substrates (and not articles such as CDs) of a size greater than A4 but less than 2 meters wide. Such printers are typically suitable for use in high street copy and printing shops.

The printer of the invention will also comprise devices which are conventional in ink jet printers such as those for effecting relative movement to the substrate and the print head and for controlling the operation of the printer.

The substrate may be a manufactured article such as a mobile phone casing, CD or DVD, light bulb or bottle. Preferably, the substrate is in sheet form, for example, paper, acrylic or vinyl sheets.

Embodiments of the invention will now be described for the purposes of illustration only with reference to the following figures in which:

FIGS. 1*a*, 1*b* and 1*c* show in schematic form different arrangements of a printer of the invention;

Figure 1A:
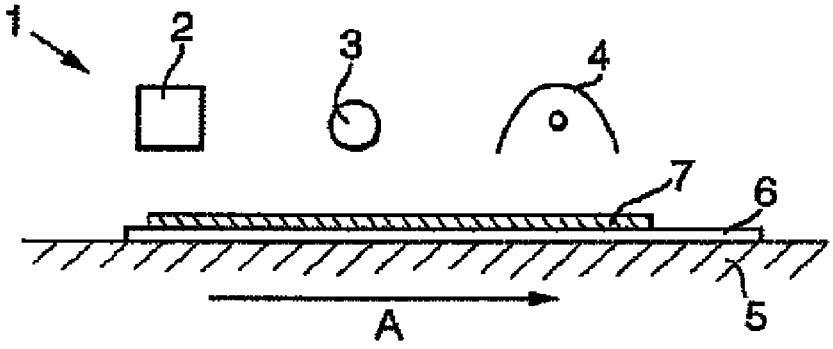

FIG. 1*a* shows a printer 1 according to the invention comprising a print head 2, an IR lamp 3 and a mercury discharge lamp 4 arranged in sequence over a platen 5. A sheet substrate 6 is shown being carried on the platen by a transport mechanism (not shown in FIG. 1*a*) in the direction of arrow A. On the uppermost surface of substrate is a film of ink 7 which has been jetted onto the substrate from print head 2 in accordance with instructions received from a control device (not shown in FIG. 1*a*). As the substrate is carried in the direction of arrow A, ink film passes under IR lamp 3 which heats the ink film to an elevated temperature. The heated ink together with the substrate which is also heated by the IR lamp 3 then passes under mercury lamp 4 which illuminates the substrate and the ink with the UV radiation with a UV dose sufficient to cure the ink.

Figure 1B:
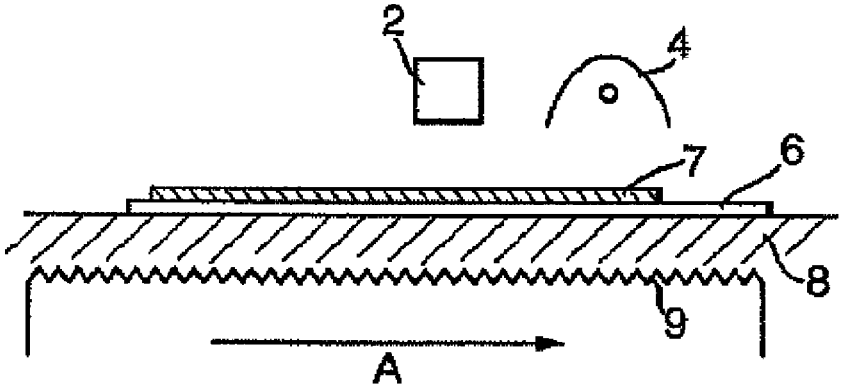

FIG. 1*b* shows an alternative printer which instead of having an IR lamp 3 to heat the ink has instead a heated platen 8 which is heated by an electrical element 9. As the substrate is carried in the direction of arrow A ink is deposited in a film 7 on the upper surface of the substrate 6 by print head 2. The substrate is warmed by the heated platen 8 which thereby heats the ink 7 to an elevated temperature. Mercury lamp 4 cures the heated ink.

Figure 1C:
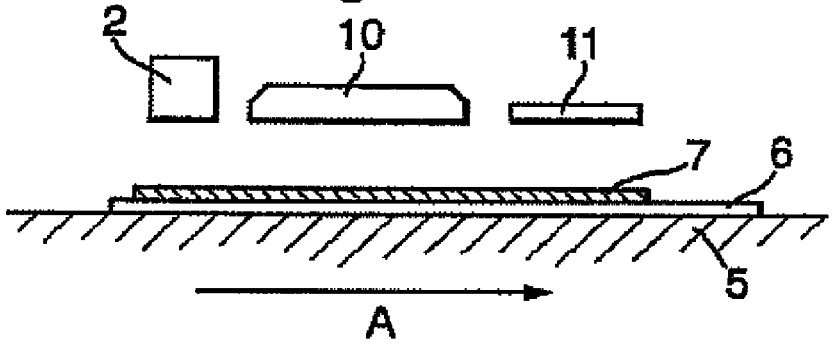

FIG. 1*c* shows a printer which comprises a NIR LED 10 which generates radiation in the NIR range arranged downstream of print head 2. Downstream of NIR array 10 is UV LED array 11. As the substrate moves in direction A, print head 2 deposits an ink 7 on the substrate 6 to form a film of liquid ink. The substrate and ink are then carried under NIR array 10 which illuminates the ink and substrate with NIR radiation which preferentially heats ink 7 to an elevated temperature. As the substrate is carried under UV LED array 11 the ink is cured to a solid film.

The print head 2 shown in FIGS. 1*a* to 1*c* may be a fixed print head extending across the full width of substrate 6 (single pass printer) or, alternatively, it may be mounted on a moving carriage which carries the print head to and fro across the width of the substrate (scanning printer).

Figure 2:
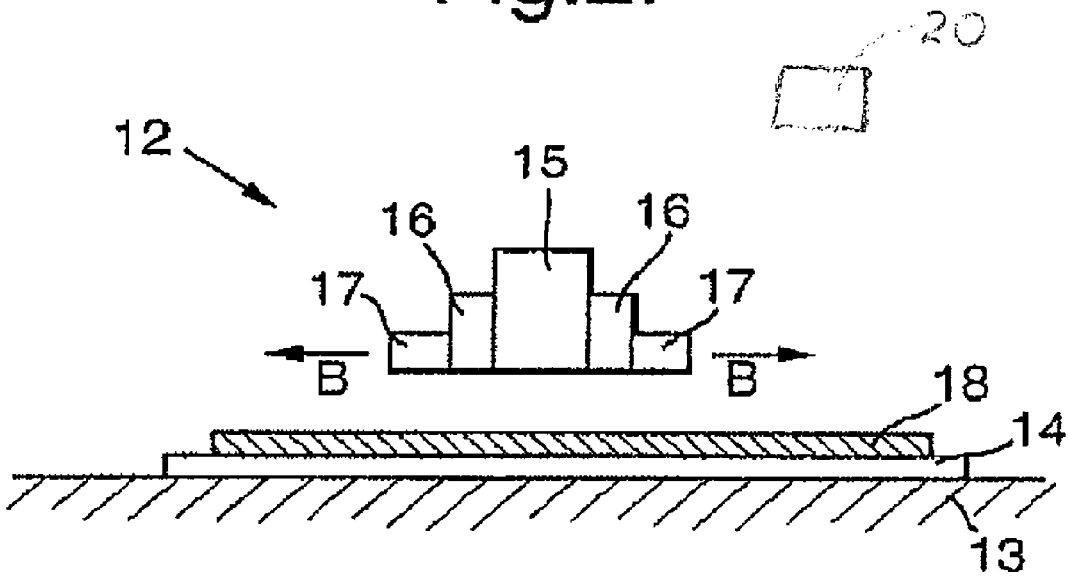
FIG. 2 illustrates in schematic form parts of a scanning printer according to the invention.

FIG. 2 shows an alternative arrangement for a scanning printer 12 according to the invention. The printer 12 includes a platen 13 which supports a substrate 14 which is being transported by a transport mechanism (not shown in FIG. 2) in the direction coming out of the paper. Mounted above the platen 13 is a print head carriage which comprises a print head 15. Commonly mounted on the print head carriage on each side of the print head 15 are two IR LED arrays 16 and two UV LED arrays 17. The print head moves from side to side across the substrate in the direction of arrows B and as it scans from side to side deposits a film of ink 18 on the substrate 14 in accordance with the instructions received from a control device 20. The IR LED array 16 warms the ink and the substrate to an elevated temperature and the UV LED array 17 irradiates the ink film with UV radiation, thereby curing the ink.

EXAMPLES

Example 1

Curing with a Mercury Lamp/Heating with a Heated Platen or IR Lamp

Ink draw downs were prepared using a 12 micron K-bar on a polyester film substrate. Those draw downs were then heated and cured according to the following procedures.

Two methods of heating the ink were adopted. In the first method, which simulated a heated platen, a metal block was heated in an oven to the required temperature. The draw down was then fixed on top of the metal block and a temperature sensitive strip was fixed alongside the draw down at the top of the block to give a constant indication of the temperature of the draw down. That assembly was then placed on a conveyor which passed at a controlled rate under a mercury discharge lamp. A light bug (IL390B from International Light) was placed alongside the metal block to measure the UV dose. After the assembly had passed underneath the UV lamp the ink film was examined to assess whether or not it had been cured. This procedure were repeated a number of times with fresh draw downs and with decreasing conveyor belt speed, thereby increasing the cure dose supplied until the cure dose was reached at which ink was cured to a solid film.

The second method of heating was by IR lamp. The draw down was placed on a mounting board which was then placed on a conveyor belt underneath the IR lamp. Once again, a temperature sensitive strip was fixed on the board next to the draw down to measure the temperature reached. The board was held under the IR lamp until the desired temperature had been obtained and was then allowed to pass on the conveyor underneath the UV lamp, where the curing procedure was as before.

Figure 3:
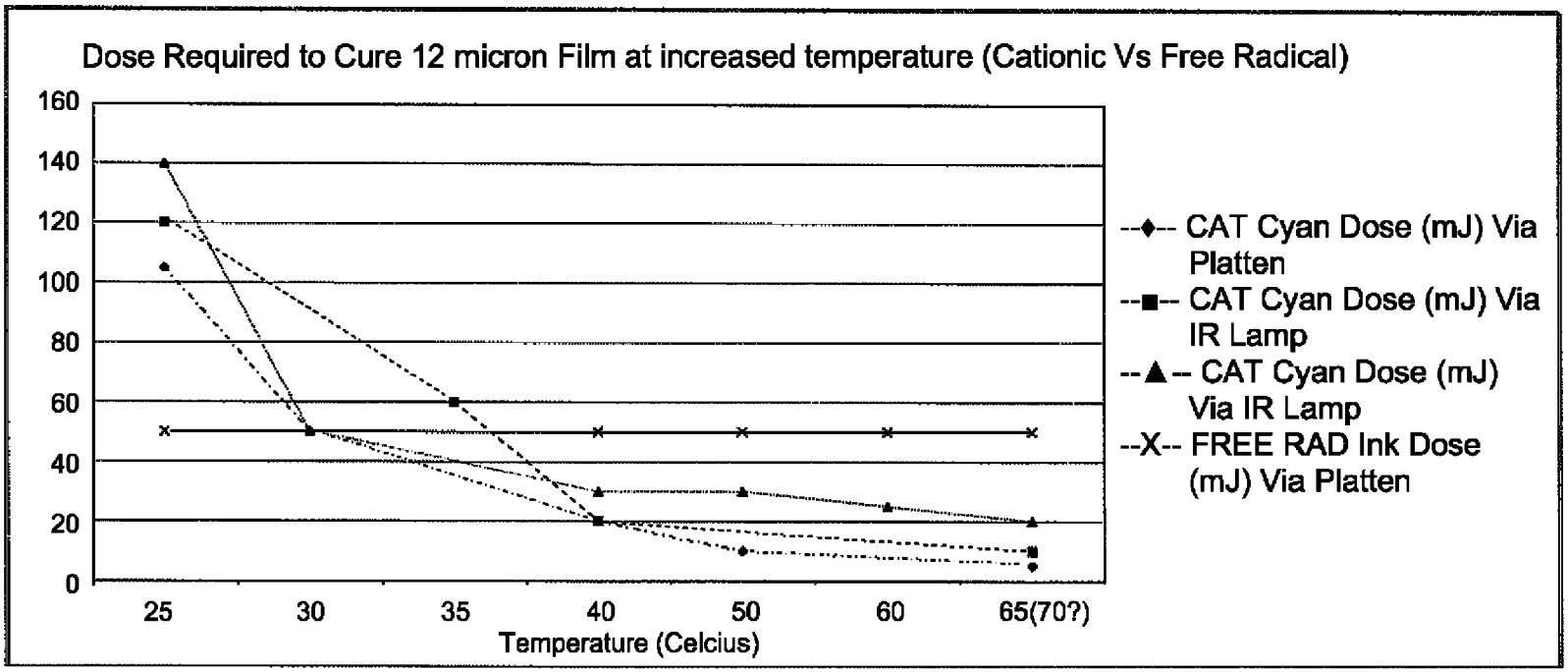
FIG. 3 shows a graph of cure dose versus temperature for a range of inks cured by a mercury lamp.

Three inks were tested. A cationic cyan ink was assessed according to both the IR and the simulated platen heating procedures and a cationic yellow ink and a free radical ink were each assessed via the simulated platen heating method only. The results are shown in FIG. 3 in the form of a graph of the cure dose required to cure the film versus temperature. As can be seen from that figure, the radical ink cured at the same dose at all temperatures whereas the cationic inks showed a marked reduction in the UV dose required for curing with an increase in temperature. As can be seen from FIG. 3, very significant reductions in cure dose required were achieved by heating the ink only 5° C. from 25° C. to 30° C., and above 40° C. the rate of decrease of cure dose required reduced.

Example 2

Curing with a UV LED Array/Heating with a Heated Platen

In this example the cyan cationic ink used in Example 1 was drawn down on a polyester sheet as described for Example 1. The draw down was then heated using the simulated heated platen method described as for Example 1. That draw down/temperature sensitive strip/metal block assembly was then placed underneath a UV LED array and cured for a predetermined period of time. The ink film was then examined to see whether or not it had cured. This procedure was repeated using fresh draw downs and using increased durations of curing to increase the cure dose until a cure dose was reached at which the ink film was cured. As for Example 1, the cure dose was measured using a light bug (IL390B) which was placed under the LED alongside the draw down assembly for the set duration.

That procedure was then repeated using a different cationic cyan ink formulation which included a sensitizer which increased the sensitivity of the ink to the UV radiation emitted by the LED. A further repeat experiment was carried out using a free radical ink for comparison and the results are shown in FIG. 4 as a graph of the dose required to cure the film versus temperature of the ink film.

Figure 4:
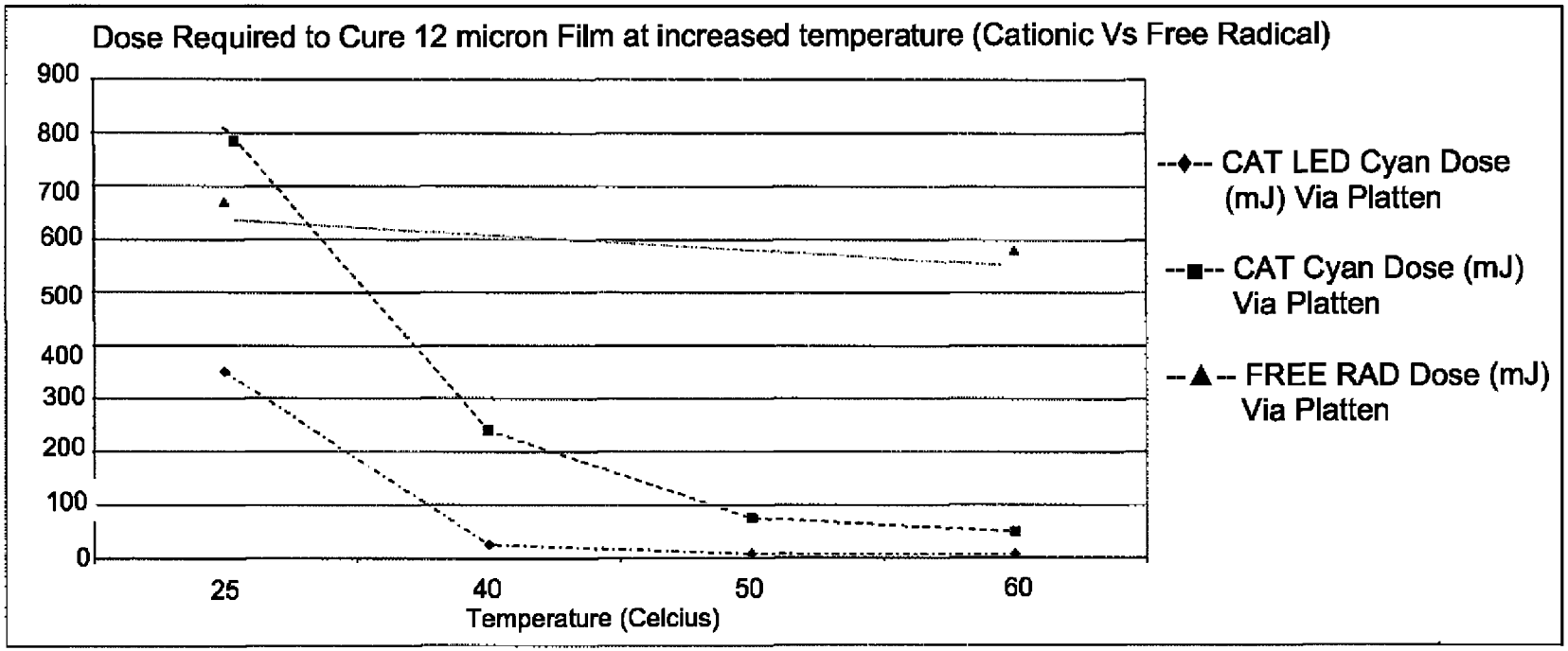
FIG. 4 shows a further graph of cure dose versus temperature for various inks cured by a UV LED.

As can be seen from FIG. 4, the free radical ink showed only a very small decrease in cure dose required whereas, once again, the cationic ink formulations showed a very significant decrease in cure dose required with increasing temperature. As expected, the cationic ink comprising the sensitizer required a significantly lower UV dose than the un-sensitized cationic ink formulation.

Example 3

Curing with a UV Mercury Lamp/Heating with a Near IR Lamp

In this example the ink was applied to thin gauge low density polyethylene film using a 12 micron K-bar to give a uniform ink film. The inked polyethylene film was placed upon a conveyor belt which carried it under a near infrared heating device consisting of a radiation module MPP having 12 NB emitters (Adphos, Advanced Photonics Technologies AG, Bruckmuhl Stabe 27, 83052, Bruckmuhl-Heufeld, Germany). The temperature of the film immediately after passing under the heating device was measured with a Raytek hand pyrometer (e=0.95) and the heated ink film was then carried under a UV curing unit consisting of a UV Power Cube mercury lamp (also from Adphos). The output of the UV Power Cube was adjusted until a UV dose was reached at which the ink film just cured (the curing level was tested 0.5 seconds after the film emerged from the curing unit) and that curing dose was then measured with an international light IL390B light bug. The relative humidity was measured using a Comark Evolution N8004 Hygrometer (Comark, Stevenage, Hertfordshire, England).

Figure 5:
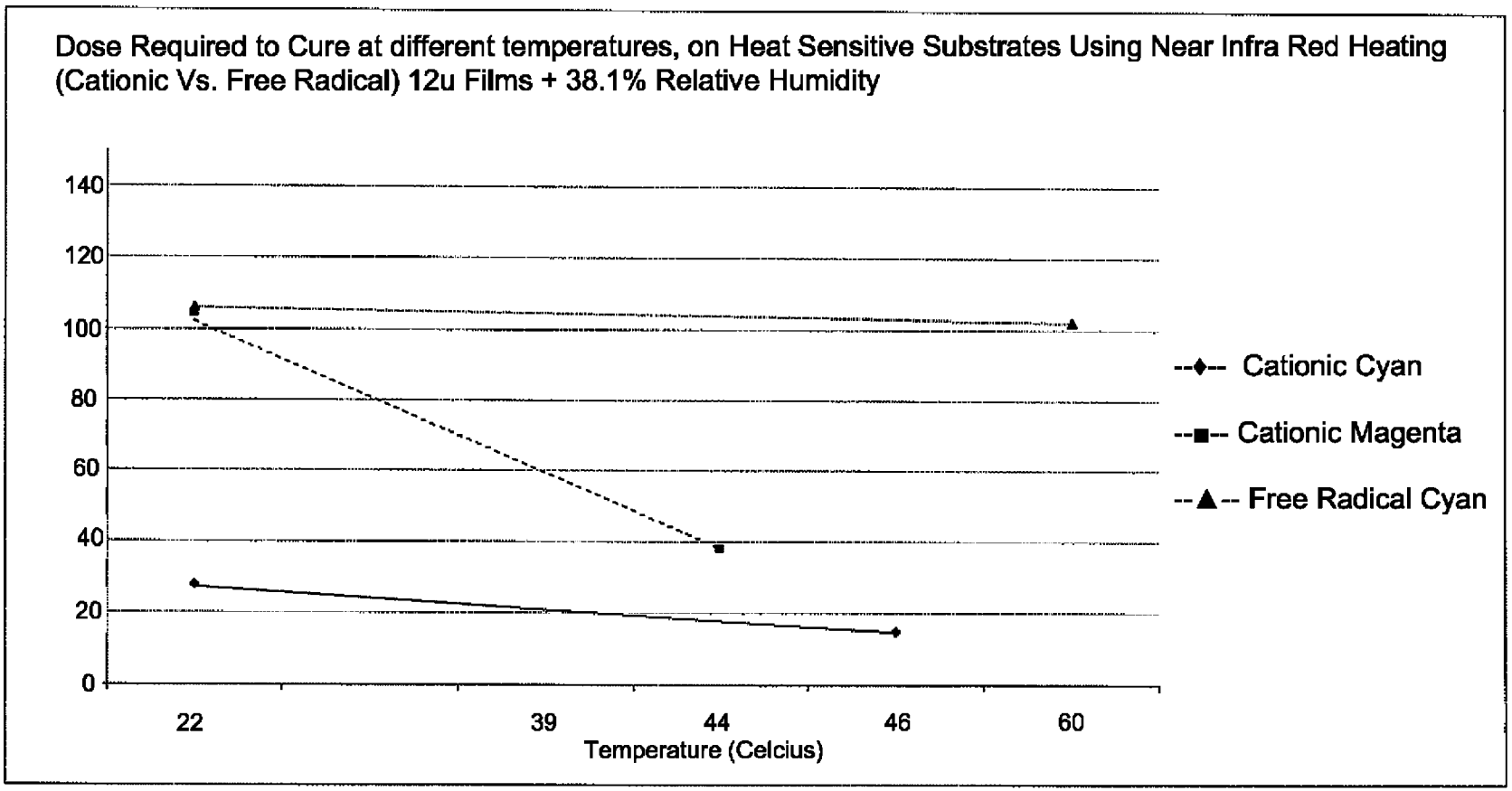
FIG. 5 shows a graph of cure dose versus temperature for various inks heated by near infrared radiation and cured by a mercury lamp.

The procedure was carried out once with the near IR heating unit turned off so that the inked film was at room temperature (22° C.) during the curing and then the process was repeated with a heating unit turned on such that the curing was carried out at an elevated temperature. Three different inks were tested, a cationic cyan, a cationic magenta, and a free radical cyan. The results are shown in FIG. 5 from which it can be seen that the two cationic inks exhibited a significant decrease in cure dose required to cure when raised to temperatures of 44 and 46° C. whereas the free radical cyan ink appeared to show little or no decrease in UV dose required to cure even when raised to 60° C.

Example 4

Curing with a UV Mercury Lamp/Heating with a Radio Frequency (RF) Heater

A UV curable ink jet ink was applied to the substrate, thin gauge low density polyethylene film, using a 12 micron k-bar. The inked film was then placed on a conveyor belt which carried the film first under a RF heater unit consisting of a dielectric lab oven (a Strayfield 1.5 kW RF Trials Unit from Strayfield Fastran, Ely Road, Theale, Berkshire, England, RG7 4BQ) and then under a UV curing unit consisting of a Nordson Laboratory Conveyer Cure Unit with dichroic reflectors and water cooling (an elevated bed was used to minimise the distance between the lamp and the substrate). The cure unit was fitted with a Primarc 75 mm 240 W/cm mercury arc lamp. The curing level was assessed at 0.5 seconds after the print emerged from the cure tunnel and the speed of the conveyor was adjusted until a cure dose was reached at which the ink was just cured. The temperature of the ink film was measured immediately prior to entry into the cure unit using a 3M infrared thermometer. The relative humidity was measured using a Comark Evolution N8004 hygrometer (Comark, Stevenage, Hertfordshire, England). The cure dose was measured using an international light IL390B light bug.

Figure 6:
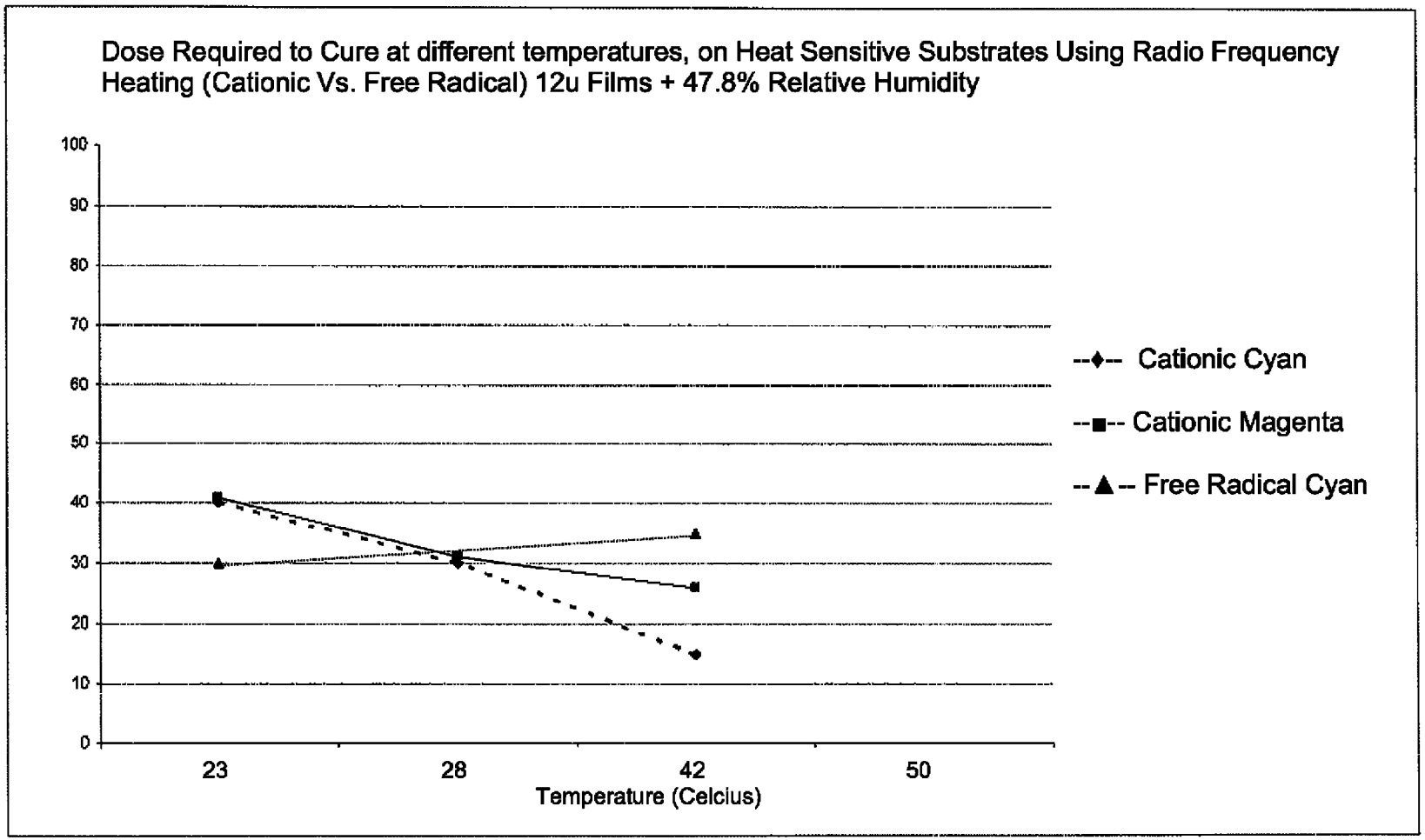
FIG. 6 shows a graph of cure does versus temperature for various inks heated by an RF heater and cured using a mercury lamp.

The procedure was repeated for three different inks (cationic cyan, cationic yellow and free radical cyan) at three different temperatures for each ink. The results are shown in FIG. 6 from which it can be seen that the cure dose required to cure the cationic cyan and cationic yellow inks decreased significantly on going from 23 to 42° C. whereas the cure dose required to cure the free radical cyan ink actually increased slightly over the same temperature range.

Examples 3 and 4 demonstrate that near IR and RF heating can be used to reduce the cure dose required to cure inks on a temperature sensitive substrate.

The invention claimed is:

1. An ink jet printer for printing a cationic ink jet ink comprising:

a print head for printing the ink onto a substrate, a heating means for heating the ink on the substrate, a source of radiation for curing the heated ink, and a controller which controls curing of said heated ink such that greater than about a 50% reduction in cure dose is exhibited at temperatures above 40° C. relative to a cure dose at 25° C.

2. An ink jet printer as claimed in claim 1 in which the heating means comprises an infrared lamp.

3. An ink jet printer as claimed in claim 2 in which the heating means comprises a source of near-infrared radiation.

4. An ink jet printer as claimed in claim 1 in which the heating means comprises a source of radio frequency (RF) radiation.

5. An ink jet printer as claimed in claim 1 in which the heating means comprises a heated platen.

6. An ink jet printer as claimed in claim 1 in which the radiation source comprises an ultra-violet light emitting diode (UV LED).

7. An ink jet printer as claimed in claim 1 which is a scanning printer.

8. An ink jet printer as claimed in claim 7 which comprises ultraviolet LED arrays arranged on either side of the print head which scan across the substrate with the print head.

9. An ink jet printer as claimed in claim 1 in which the cure dose is reduced by about 50-75%.

10. An ink jet printer comprising:

one or more reservoirs containing cationic ink jet ink, a print head for printing the cationic ink jet ink onto a substrate, a heating means for heating the ink on the substrate, a source of radiation for curing the heated ink, and a controller which controls curing of said heated ink such that greater than about a 50% reduction in cure dose is exhibited at temperatures above 40° C. relative to a cure dose at 25° C.

11. An ink jet printer as claimed in claim 10 in which the cure dose is reduced by about 50-75%.

12. A process of ink jet printing using an ink jet printer comprising the steps of:

i) ink jet printing a cationic ink jet ink onto a substrate;

ii) heating the ink on the substrate; and iii) using ultraviolet radiation to cure the ink such that greater than about a 50% reduction in cure dose is exhibited at temperatures above 40° C. relative to a cure dose at 25° C.

13. A process as claimed in claim 12 in which the substrate is heat sensitive and the ink is heated on the substrate with NIR radiation.

14. A process as claimed in claim 12 in which the substrate is heat sensitive and the ink is heated on the substrate with radio frequency (RF) radiation.

15. A process as claimed in claim 12 in which the ink is heated such that it is at a temperature of at least 30° C. immediately prior to the curing of the ink.

16. A process as claimed in claim 15 in which the ink is heated such that it is at a temperature in the range of from 35 to 60° C. immediately prior to the curing of the ink.

17. A process as claimed in claim 12 in which the substrate is a substrate for a graphic display product.

18. The process as claimed in 12 in which the cure dose is reduced by about 50-75%.

* * * * *